US012782013B2

(12) United States Patent
Madsen et al.

(10) Patent No.: US 12,782,013 B2
(45) Date of Patent: Nov. 3, 2026

(54) HEAT EXCHANGER ARRANGEMENT AND METHOD OF CONTROLLING SAME

(71) Applicant: Maersk Container Industry A/S, Tinglev (DK)

(72) Inventors: Poul Kim Madsen, Tinglev (DK); Marian-Ciprian Niculuță, Tinglev (DK)

(73) Assignee: Maersk Container Industry A/S, Tinglev (DK)

( * ) Notice: Subject to any disclaimer, the term of this patent is extended or adjusted under 35 U.S.C. 154(b) by 186 days.

(21) Appl. No.: 18/654,840

(22) Filed: May 3, 2024

(65) Prior Publication Data

US 2024/0288204 A1 Aug. 29, 2024

Related U.S. Application Data

(63) Continuation of application No. PCT/EP2022/080887, filed on Nov. 4, 2022.

(30) Foreign Application Priority Data

Nov. 5, 2021 (DK) ..... PA202101058

(51) Int. Cl.
*F25B 41/31* (2021.01)
*F25B 49/02* (2006.01)

(52) U.S. Cl.
CPC ..... *F25B 41/31* (2021.01); *F25B 49/02* (2013.01); *F25B 2600/25* (2013.01)

(58) Field of Classification Search
CPC ..... F25B 2600/25; F25B 2600/2511; F25B 39/028; F25B 41/20; F25B 41/31; F25B 41/385; F25B 49/02; F25B 7/00
See application file for complete search history.

(56) References Cited

U.S. PATENT DOCUMENTS 6,722,145 B2 4/2004 Podtchereniaev et al.
9,440,514 B2 * 9/2016 Kondo ..... B60H 1/2225
(Continued)

FOREIGN PATENT DOCUMENTS

EP 2587192 A2 5/2013
EP 2672205 A2 12/2013
(Continued)

OTHER PUBLICATIONS

Denmark 1st technical examination and search report dated PA202101058 for Denmark Application No. Mar. 22, 2022.
(Continued)

*Primary Examiner* — Henry T Crenshaw
(74) *Attorney, Agent, or Firm* — Fish & Richardson P.C.

(57) ABSTRACT

Provided is a heat exchanger arrangement for a refrigeration system. The heat exchanger arrangement comprises a heat exchanger having a first flow path, a second flow path, and a heat exchange interface that is configured to transfer heat between a first fluid in the first flow path and a second fluid in the second flow path, in use. The heat exchanger arrangement also comprises an inlet arrangement having a first-fluid inlet for receiving the first fluid from a source, a first opening into the first flow path, and a second opening into the first flow path. The inlet arrangement is operable to control flow of the first fluid from the first-fluid inlet to the first opening and to the second opening.

32 Claims, 3 Drawing Sheets

(56) References Cited

U.S. PATENT DOCUMENTS

| | | | | |
|---|---|---|---|---|
| 10,782,053 | B1 | 9/2020 | Murray et al. | |
| 2004/0118139 | A1 | 6/2004 | Kelly et al. | |
| 2015/0354864 | A1* | 12/2015 | Katayama | B60H 1/00921 62/238.7 |
| 2018/0139870 | A1* | 5/2018 | Meadows | F25B 43/003 |
| 2019/0128568 | A1 | 5/2019 | Scarcella et al. | |
| 2020/0158386 | A1* | 5/2020 | Wu | F25B 30/02 |

FOREIGN PATENT DOCUMENTS

| | | | |
|---|---|---|---|
| EP | 3070418 | A2 | 9/2016 |
| JP | 2012172920 | A | 9/2012 |
| JP | 5202666 | B2 | 6/2013 |
| JP | 2013148330 | A | 8/2013 |

OTHER PUBLICATIONS

Intentional Search Report and Written Opinion dated Feb. 14, 2023 for International Patent Application No. PCT/EP2022/080887.
International Preliminary Report on Patentability in International Appln. No. PCT/EP2022/080887, mailed on May 16, 2024, 8 pages.
International Search Report and Written Opinion in International Appln. No. PCT/EP2022/080887, mailed on Feb. 14, 2023, 10 pages.
Office Action in European Appln. No. 22813539.8, mailed on Aug. 6, 2025, 3 pages.

* cited by examiner

HEAT EXCHANGER ARRANGEMENT AND METHOD OF CONTROLLING SAME

CROSS-REFERENCE TO RELATED APPLICATIONS

This application is a continuation under 35 U.S.C. § 120 of International Application No. PCT/EP2022/080887, filed Nov. 4, 2022 which claims priority to Denmark Application No. PA202101058, filed Nov. 5, 2021, under 35 U.S.C. § 119(a). Each of the above-referenced patent applications is incorporated by reference in its entirety.

TECHNICAL FIELD

The present invention relates to heat exchanger arrangements, methods of controlling heat exchanger arrangements, refrigeration systems comprising heat exchanger arrangements, storage units comprising refrigeration systems, and marine vessels comprising storage units.

BACKGROUND

Many types of cargo may be stored in transportable storage units, also referred to as transport units, for transporting cargo on container vessels. Such a storage unit may comprise an atmosphere control system for controlling an atmosphere in the storage unit. This may be used to facilitate the storage and transportation of perishable goods, such as fruit, vegetables, or fresh or frozen meat or fish, or other goods, such as medicaments, in the transport unit. The atmosphere control system may comprise a refrigeration system for controlling a temperature of the atmosphere in the storage unit. Transport units include reefer containers, which may be TEU or 2-TEU containers designed to be shipped on container vessels, and/or refrigerated trucks or trailers.

SUMMARY

It is an object of the present invention to improve an efficiency and/or reduce a size of such refrigeration systems, and particularly to improve an efficiency and/or reduce a size of heat exchangers for refrigeration systems, such as refrigeration systems for transport units.

According to a first aspect of the present invention, there is provided a heat exchanger arrangement for a refrigeration system, the heat exchanger arrangement comprising: a heat exchanger comprising a first flow path, a second flow path, and a heat exchange interface that is configured to transfer heat between a first fluid in the first flow path and a second fluid in the second flow path, in use; and an inlet arrangement comprising a first-fluid inlet for receiving the first fluid from a source, a first opening into the first flow path, and a second opening into the first flow path, wherein the inlet arrangement is operable to control flow of the first fluid from the first-fluid inlet to the first opening and to the second opening.

It will be understood that each of the first and second flow paths comprises a respective identifiable volume through which fluid can flow. In other words, the first opening and the second opening each open into the first flow path, i.e. into the same identifiable fluid volume through which fluid can flow. Providing an inlet arrangement operable to control flow of the first fluid from the first-fluid inlet to the first opening and to the second opening may improve a quality and/or distribution of the first fluid in the heat exchanger, and/or over the heat exchange interface in the heat exchanger. This may improve an efficiency of the heat exchanger, and/or permit a smaller heat exchanger to achieve a given heat exchange capacity.

Optionally, the inlet arrangement comprises a selector valve and/or directional control valve. The selector valve and/or directional control valve may be operable to direct the first fluid from the first-fluid inlet to either the first opening or the second opening. In use, the selector valve and/or directional control valve may be fluidically coupled downstream of an expansion valve for reducing a pressure of the first fluid passing therethrough. By using a selector and/or directional control valve to control a flow of the first fluid to the first opening and to the second opening, a number of moving parts in the inlet arrangement may be reduced, which may reduce a complexity and/or a cost of the heat exchanger arrangement.

Optionally, the first fluid comprises a first refrigerant of the refrigeration system. Optionally, the second fluid comprises a second refrigerant of the refrigeration system. Alternatively, the second fluid is a fluid other than a refrigerant, such as cooling water. It may be particularly advantageous when the first fluid is a first refrigerant, particularly in a vapour phase, as this may improve a distribution of a liquid refrigerant in the heat exchanger, and/or reduce a stratification of liquid-phase and gas-phase refrigerant in the heat exchanger. Improved heat exchange characteristics may be achieved when a larger area of the heat exchange interface is in contact with liquid-phase refrigerant.

Optionally, the heat exchanger arrangement comprises an outlet arrangement comprising a first-fluid outlet that is fluidically coupled to the first flow path, and through which the first fluid can flow out of the heat exchanger, in use. Optionally, the outlet arrangement comprises a first outlet opening into the first flow path and a second outlet opening into the first flow path. Optionally, the first and second outlet openings are fluidically coupled to the first-fluid outlet, so that the first fluid can flow from the first and second outlet openings to the first-fluid outlet, in use. Providing plural outlet openings into the first flow path may improve a pressure distribution in the heat exchanger as the first fluid leaves the heat exchanger, in use, which may improve an efficiency of the heat exchanger.

Optionally, the heat exchanger arrangement comprises a second-fluid inlet and a second-fluid outlet, wherein the first flow path is fluidically coupled between the first-fluid inlet and the first-fluid outlet and the second flow path is fluidically coupled between the second-fluid inlet and the second-fluid outlet.

One or both of the first and second flow paths may comprise plural fluid flow channels. Optionally, the first and second openings both open into each of the plurality of fluid flow channels Optionally, the heat exchanger is a plate heat exchanger. The heat exchanger may comprise a series of plates in a laminar arrangement. Optionally, the series of plates is arranged so that each pair of adjacent plates in the series alternately define a fluid flow channel of the first flow path and a fluid flow channel of the second flow path. In this way, each plate may form at least a part of the heat exchange interface. Optionally, the heat exchanger comprises up to 20 plates, up to 40 plates, up to 60 plates, up to 80 plates, or more than 80 plates.

Optionally, the heat exchanger comprises a first endplate, defining a first plate in the series of plates, and a second endplate, defining a last plate in the series of plates. Optionally, the first opening opens into the first flow path in proximity to the first endplate, and the second opening opens into the first flow path in proximity to the second endplate. In this way, the inlet arrangement may be operable to control a side of the heat exchanger into which the first fluid is supplied from the first-fluid inlet. By controlling a flow of the first fluid to either side of the heat exchanger, a distribution of the first fluid over the heat exchange interface in the heat exchanger, and thereby an efficiency of the heat exchanger, may be improved. Alternatively, the first and second openings each open into the first flow path in proximity to opposite lateral or longitudinal edges of the same endplate.

Optionally, the first outlet opening opens into the first flow path in proximity to one of the first and second endplates, and the second outlet opening opens into the first flow path in proximity to the other of the first and second endplates. Alternatively, the first and second outlet openings each open into the first flow path in proximity to opposite lateral or longitudinal edges of the same endplate. By allowing the first fluid to leave the heat exchanger from opposite endplates, or from opposite lateral or longitudinal edges of the same endplate, a pressure distribution in the heat exchanger may be improved, which may in turn improve a longevity and/or efficiency of the heat exchanger.

Optionally, the inlet arrangement comprises a first valve operable to selectively fluidically couple the first-fluid inlet to the first opening, and a second valve operable to selectively fluidically couple the first-fluid inlet to the second opening.

Providing separate first and second valves may allow flow of the first fluid from the first fluid inlet to the first opening and to the second opening to be controlled in a more direct and/or more accurate manner. For instance, it may be possible to separately control a flow rate at which, and/or an amount of time the first fluid is supplied from the first-fluid inlet to one of the first and second openings, without affecting a supply of the first fluid to the other of the first and second openings. This may permit more complicated flow regimes to be achieved, which may in turn improve an efficiency of the heat exchanger.

Optionally, the first and second valves are ON/OFF valves, such as solenoid valves. Optionally, the first and second valves are variable flow control valves operable to control a flow rate of the first fluid therethrough, such as proportional solenoid valves or servo valves. Optionally, in use, the first and second valves are fluidically coupled downstream of an expansion valve for reducing a pressure of the first fluid passing therethrough.

Optionally, the inlet arrangement comprises an expansion valve.

The expansion valve may be for reducing a pressure and/or a mass flow rate of the first fluid flowing therethrough, in use. The expansion valve may be an electronically-controlled expansion valve, such as a solenoid valve, which may be operable to selectively fluidically couple and isolate the first-fluid inlet with the first and/or the second opening. A better level of control of the flow of refrigerant through the expansion valve may be achieved by using an electronically-controlled expansion valve.

Optionally, the first and second valves, where provided, are first and second expansion valves. In this way, where the first fluid is a refrigerant of the refrigeration system, the first and second expansion valves may be operable to expand the first fluid, such as to reduce a temperature and/or pressure of the first fluid, such as to cause some of the first fluid to change phase. In this way, the first and second valves may serve a dual purpose to vaporise refrigerant passing therethrough and to control when, and how much, refrigerant is passed to the heat exchanger through the respective first and second openings. This may reduce a complexity and/or cost of the heat exchanger arrangement, and/or may improve a reliability of the heat exchanger arrangement.

Optionally, the heat exchanger arrangement comprises a controller configured to cause operation of the inlet arrangement to control flow of the first fluid from the first-fluid inlet to the first opening and to the second opening.

The controller may advantageously permit automatic operation of the inlet arrangement, such as to achieve a desired heat exchange capacity of the heat exchanger. Optionally, where the inlet arrangement comprises the first valve and the second valve, the controller is configured to cause operation of the first and second valves to control flow of the first fluid from the first-fluid inlet to the first opening and to the second opening.

The controller may be a local controller, such as a controller of a system in which the heat exchanger is installed, or the controller may be a remote controller. The controller may be communicatively coupled to the inlet arrangement, such as to the first and second valves, where provided. This may be by a wired or wireless communication link.

Optionally, the controller is configured to cause operation of the inlet arrangement alternately in a first mode and a second mode, wherein, in the first mode, the first fluid is caused to flow from the first-fluid inlet to the first opening, and in the second mode, the first fluid is caused to flow from the first-fluid inlet to the second opening.

This may be by the controller causing the first and second valves, where provided, to alternately open and close. By alternately switching between the first and second modes, the first fluid may be supplied alternately to different locations in the heat exchanger, such as into opposite sides of the heat exchanger when the heat exchanger is a plate heat exchanger, as described above. This may improve a distribution of the first fluid over the heat exchange interface in the heat exchanger, Optionally, the controller is configured to cause, for a period when switching between the first mode and the second mode, operation of the inlet arrangement so that the first fluid is supplied from the first-fluid inlet to the first and second openings at the same time.

Where the heat exchanger arrangement comprises the first and second valves, this may be by the controller causing the second valve to open before the first valve is closed, and/or by the controller causing the first valve to open before the second valve is closed. Optionally, where the first and second valves are variable flow control valves, the controller may cause the second valve to gradually open as the first valve, where provided, is gradually closed, and/or the controller may cause the first valve to gradually open as the second valve is gradually closed. This may ensure that the first fluid is consistently supplied to the first flow path, such as to avoid periods of time where little, or none, of the first fluid is supplied to the first flow path. This may improve an efficiency of the heat exchanger arrangement, and/or may allow a higher heat exchange capacity to be achieved from the heat exchanger.

Alternatively, the controller may be configured to cause the inlet arrangement to operate in the second mode immediately after operating in the first mode, and/or to operate in the first mode immediately after operating in the second mode. In this way, there may be no simultaneous flow from the first-fluid inlet to both the first and second openings, such as, when switching between the first and second modes. Alternatively, the controller may be configured to cause, for the period when switching between the first mode and the second mode, operation of the inlet arrangement to prevent a flow of the first fluid from the first-fluid inlet to the first opening and the second opening. This may lead to a period of time in which the first fluid is prevented from flowing into the heat exchanger. This may be to achieve a desired heat exchange capacity using the heat exchanger, such as when the heat exchange capacity would be too high if the first fluid were to be constantly supplied to the heat exchanger.

Optionally, the controller is configured to cause operation of the inlet arrangement in a repeating first cycle so that, during a first on-period defining a start of the first cycle, the first fluid is caused to flow from the first-fluid inlet to the first opening, and during a first off-period defining a remainder of the first cycle, the first fluid is prevented from flowing from the first-fluid inlet to the first opening. This may be by the controller causing the first valve, where provided, to open during the first on-period, and to close during the first off-period. The controller may be configured to cause operation of the inlet arrangement in the first mode for at least some of the first on-period.

Optionally, the controller is configured to cause operation of the inlet arrangement in a repeating second cycle so that, during a second on-period defining a start of the second cycle, the first fluid is caused to flow from the first-fluid inlet to the second opening, and during a second off-period defining a remainder of the second cycle, the first fluid is prevented from flowing from the first-fluid inlet to the second opening. This may be by the controller causing the second valve, where provided, to open during the second on-period, and to close during the second off-period. The controller may be configured to cause operation of the inlet arrangement in the second mode for at least some of the second on-period.

Optionally the first cycle has a first cycle period, which is a sum of the first on-period and the first off-period. Optionally, the second cycle has a second cycle period, which is a sum of the second on-period and the second off-period. Optionally, the first cycle period and the second cycle period are equal. In other words, the first and second cycle periods may have a common cycle period. The common cycle period may be up to 3 seconds, up to 6 seconds, or more than 6 seconds.

Optionally, the controller is configured to cause operation of the inlet arrangement so that a delay between the start of the first cycle and the start of the second cycle is up to half, or more than half, of the first cycle period, and/or so that a delay between the start of the second cycle and a start of the first cycle is up to half, or more than half, of the second cycle period. In other words, the controller may be configured to cause operation of the inlet arrangement so that the second cycle begins halfway through the first cycle period, and/or so that the first cycle begins halfway through the second cycle period. In this way, where the first and second cycle periods have a common cycle period, the first and second cycles may be synchronised so as to be temporally offset by half of the common cycle period. This may provide a more regular and even supply of the first fluid to the first and second openings, such as to either side of the heat exchanger as described above. This may, in turn, improve a distribution of, and/or reduce a stratification of, the first fluid in the heat exchanger, in use.

The first on-period may be longer than, the same as, or shorter than the first off-period. The first on-period may account for up to 20%, up to 50%, up to 70%, or up to 100% of the first cycle period. In other words, the first cycle period may consist entirely of the first on-period, and there may be no first off-period in which the first fluid is prevent from flowing to the first opening from the first-fluid inlet. The second on-period may be longer than, the same as, or shorter than the second off-period. The second on-period may account for up to 20%, up to 50%, up to 70%, or up to 100% of the second cycle period. In other words, the second cycle period may consist entirely of the second on-period, and there may be no second off-period in which the first fluid is prevent from flowing to the second opening from the first-fluid inlet.

It will be appreciated that, where the first on-period is longer than the first off-period, and/or where the second on-period is longer than the second off-period, the first and second on-periods may overlap, so that the first fluid is supplied from the first-fluid inlet to the first opening and to the second opening simultaneously during the overlapping period. This may particularly be the case where the first and second cycles are synchronised so as to be temporally offset by half of a common cycle period, as described above. This may lead to the advantages described above in relation to a simultaneous flow of the first fluid to the first and second openings when switching between the first and second modes.

Alternatively, where the first on-period is shorter than the first off-period, and/or where the second on-period is shorter than the second off-period, the first and second off-periods may overlap, so that the first fluid is prevented from flowing from the first-fluid inlet to the first opening and the second opening during the overlapping off-period. This may provide similar advantages to those described above in relation to preventing flow of the first fluid to the first and second openings when switching between the first and second modes.

Optionally, the controller is configured to cause operation of the inlet arrangement to vary the first on-period and the first off-period, and/or to vary the second on-period and second off-period. This may be by maintaining fixed respective first and second cycle periods, or by varying the respective first and second cycle periods. This may be to meter an overall amount of the first fluid supplied to the heat exchanger, such as to control a heat exchange capacity achieved by the heat exchanger.

A second aspect of the present invention provides a method of controlling a heat exchanger arrangement for a refrigeration system, the heat exchanger arrangement comprising: a heat exchanger comprising a first flow path, a second flow path, and a heat exchange interface that is configured to transfer heat between a first fluid in the first flow path and a second fluid in the second flow path, and an inlet arrangement comprising a first-fluid inlet for receiving the first fluid from a source, a first opening into the first flow path, and a second opening into the first flow path. The method comprises controlling flow of the first fluid from the first-fluid inlet to the first opening and to the second opening.

It will be appreciated that any of the optional features and/or advantages of the heat exchanger arrangement of the first aspect may similarly be applied to the heat exchanger arrangement of the second aspect. It will also be appreciated that the method of the second aspect may comprise any of the actions performed by the controller of the heat exchanger arrangement of the first aspect, where provided, and/or may benefit from any of the advantages ascribed thereto.

For instance, optionally, the method comprises causing operation of the inlet arrangement alternately in a first mode and a second mode, wherein, in the first mode, the first fluid is caused to flow from the first-fluid inlet to the first opening, and in the second mode, the first fluid is caused to flow from the first-fluid inlet to the second opening.

Optionally, the method comprises causing, for a period when switching between the first mode and the second mode, operation of the inlet arrangement so that the first fluid is supplied from the first-fluid inlet to the first and second openings at the same time. Where the heat exchanger arrangement comprises the first and second valves, this may be by the method comprising causing the second valve to open before the first valve is closed, and/or by the controller causing the first valve to open before the second valve is closed.

Alternatively, the method may comprise, for the period when switching between the first mode and the second mode, preventing a flow of the first fluid from the first-fluid inlet to the first opening and to the second opening. Alternatively, the method may comprise causing the inlet arrangement to operate in the second mode immediately after operating in the first mode, and/or to operate in the first mode immediately after operating in the first second mode.

Optionally, the method comprises causing operation of the inlet arrangement in a repeating first cycle so that, during a first on-period defining a start of the first cycle, the first fluid is caused to flow from the first-fluid inlet to the first opening, and during a first off-period defining a remainder of the first cycle, the first fluid is prevented from flowing from the first-fluid inlet to the first opening. Optionally, the method comprises causing operation of the inlet arrangement in a repeating second cycle so that, during a second on-period defining a start of the second cycle, the first fluid is caused to flow from the first-fluid inlet to the second opening, and during a second off-period defining a remainder of the second cycle, the first fluid is prevented from flowing from the first-fluid inlet to the second opening. Optionally, the first cycle has a first cycle period, which is a sum of the first on-period and the first off-period, and the second cycle has a second cycle period, which is a sum of the second on-period and the second off-period Optionally, the method comprises causing operation of the inlet arrangement so that the second cycle begins halfway through the first cycle period, and so that the first cycle begins halfway through the second cycle period. Optionally, the first cycle period is the same as the second cycle period. In other words, the first and second cycles periods may have a common cycle period. The first on-period may be longer than, the same as, or shorter than the first off-period. The second on-period may be longer than, the same as, or shorter than the second off-period.

It will be appreciated that, where the first on-period is longer than the first off-period, and/or where the second on-period is longer than the second off-period, the first and second on-periods may overlap, so that the first fluid is supplied from the first-fluid inlet to the first opening and to the second opening simultaneously during the overlapping period. That is, the method may comprise causing the first fluid to flow from the first-fluid inlet to the first opening and to the second opening during the overlapping on-period.

Alternatively, where the first on-period is shorter than the first off-period, and/or where the second on-period is shorter than the second off-period, the first and second off-periods may overlap, so that the first fluid is prevented from flowing from the first-fluid inlet to the first opening and the second opening during the overlapping off-period. That is, the method may comprise preventing a flow of the first fluid from the first fluid inlet to both the first opening and the second opening during the overlapping off-period.

Optionally, the method comprises varying the first on-period and the first off-period, and/or varying the second on-period and second off-period. This may be by maintaining fixed respective first and second cycle periods, or by also varying the respective first and second cycle periods.

A third aspect of the present invention provides a controller configured to perform the method of the second aspect. Optionally, the controller is the controller of the heat exchanger arrangement of the first aspect. It will be appreciated that any of the optional features and/or advantages of the first and second aspects may similarly be applied to the third aspect.

A fourth aspect of the present invention provides a non-transitory computer-readable storage medium storing instructions that, when executed by a processor, such as a processor of the controller of the third aspect, cause the processor to perform the method of the second aspect. It will be appreciated that any of the optional features and/or advantages of the first to third aspects may similarly be applied to the fourth aspect.

A fifth aspect of the present invention provides a refrigeration system comprising the heat exchanger arrangement of the first aspect.

Optionally, the refrigeration system comprises the controller of the third aspect and/or the non-transitory computer-readable storage medium of the fourth aspect. It will be appreciated that any of the optional features and/or advantages of the first to fourth aspects may similarly be applied to the fifth aspect.

A sixth aspect of the present invention provides a transport unit comprising the heat exchanger arrangement of the first aspect, or the refrigeration system of the fifth aspect.

Optionally, the transport unit comprises the controller of the third aspect and/or the non-transitory computer-readable storage medium of the fourth aspect. It will be appreciated that any of the optional features and/or advantages of the first to fifth aspects may similarly be applied to the sixth aspect.

A seventh aspect of the present invention provides a marine vessel comprising the heat exchanger arrangement of the first aspect, the refrigeration system of the fifth aspect, or the transport unit of the sixth aspect.

Optionally, the marine vessel comprises the controller of the third aspect and/or the non-transitory computer-readable storage medium of the fourth aspect. It will be appreciated that any of the optional features and/or advantages of the first to sixth aspects may similarly be applied to the seventh aspect.

BRIEF DESCRIPTION OF DRAWINGS

Embodiments of the invention will now be described, by way of example only, with reference to the accompanying drawings, in which.

DETAILED DESCRIPTION

Figure 1:
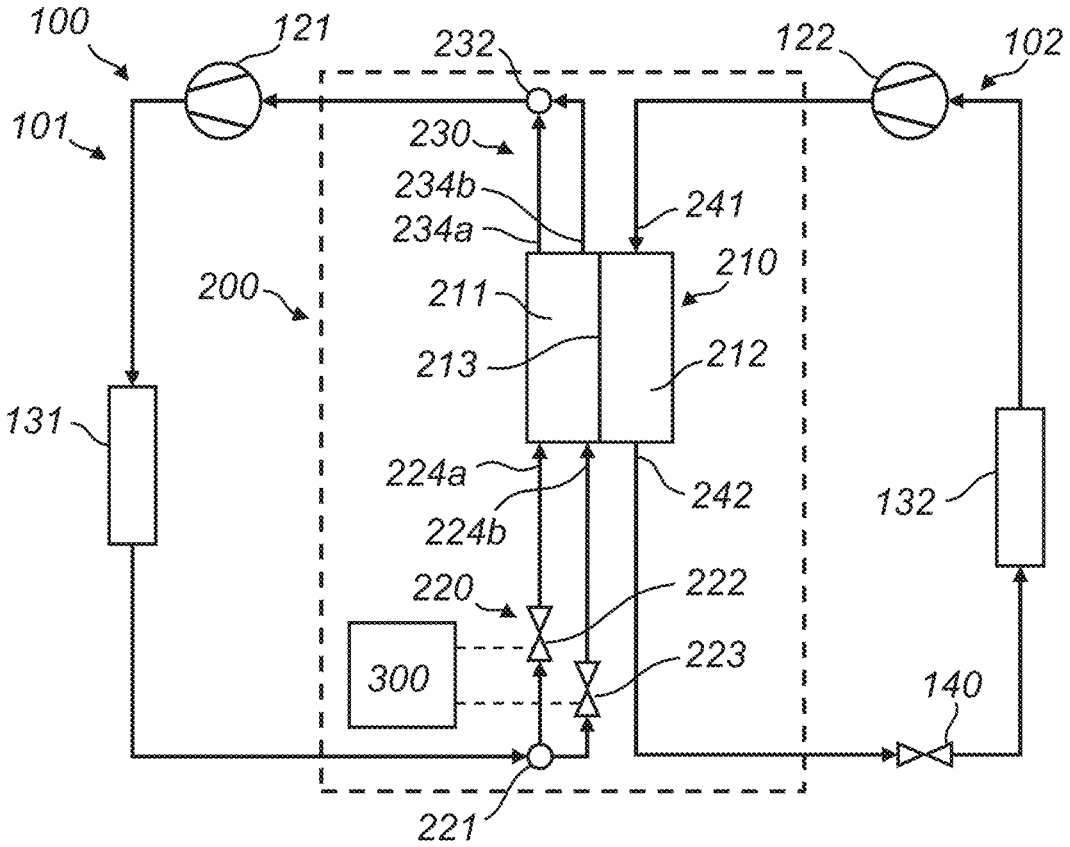
FIG. 1 shows a schematic view of an example heat exchanger arrangement comprised in an example refrigeration system.

FIG. 1 shows an example heat exchanger arrangement 200 comprised in a refrigeration system 100. The heat exchanger arrangement 200 broadly comprises a heat exchanger 210 and an inlet arrangement 220. The refrigeration system 100 is here a cascade refrigeration system 100 comprising a first refrigeration cycle 101 and a second refrigeration cycle 102, and the heat exchanger 210 is a cascade heat exchanger 210 configured to transfer heat between refrigerant in the first refrigeration cycle 101 and refrigerant in the second refrigeration cycle 102. The refrigerant in the first refrigeration cycle may herein be referred to as a "first refrigerant", and the refrigerant in the second refrigeration cycle may herein be referred to as a "second refrigerant".

It will be appreciated, however, that the heat exchanger arrangement 200 is suitable for use in any other refrigeration system. For example, the refrigeration system 100 may instead be a single-cycle refrigeration system comprising only one refrigeration cycle, and/or the heat exchanger 210 may be configured to exchange heat between a single refrigerant at two different points in a single refrigeration cycle, such as in an economiser heat exchanger, or may be configured to exchange heat between a refrigerant in the refrigeration system 100 and an external fluid, or between any two suitable fluids other than refrigerants.

The heat exchanger 210 specifically comprises a first flow path 211 fluidically coupled in the first refrigeration cycle 101, a second flow path 212 fluidically coupled in the second refrigeration cycle 102, and a heat exchange interface 213 that is configured to transfer heat between the first refrigerant in the first flow path and the second refrigerant in the second flow path, in use. The inlet arrangement 220 comprises a first fluid inlet 221, a first opening 224*a* into the first flow path 211 and a second opening 224*b* into the first flow path 211. The inlet arrangement 220 is operable to control flow of the first refrigerant from the first-fluid inlet 221 to the first opening 224*a* and to the second opening 224*b*. Specifically, in the illustrated example, this is by the inlet arrangement comprising a first expansion valve 222 that is fluidically coupled downstream of the first-fluid inlet 221 and upstream of the first opening 224*a*, and a second expansion valve 223 that is fluidically coupled in a parallel fluidic arrangement with the first expansion valve 222 downstream of the first-fluid inlet 221 and upstream of the second opening 224*b*.

The first expansion valve 222 is operable to selectively fluidically couple the first-fluid inlet to the first opening 224*a*, and the second expansion valve 223 is operable to selectively fluidically couple the first-fluid inlet to the second opening 224*b*. To achieve this functionality, the first and second expansion valves 222, 223 are ON/OFF valves, such as solenoid valves, which may be either opened or closed to permit or prevent a flow of refrigerant therethrough. The first and second expansion valves 222, 223 each comprise a respective restriction, when open, so as to reduce a pressure and/or temperature of refrigerant passing therethrough, in use.

It will be appreciated that, in other examples, any other suitable valves may be used to achieve similar functionality. For example, either of the first and second expansion valves 222, 223 may be variable flow control valves, which are operable to control a flow rate of refrigerant therethrough, such as between 0% and 100% of a maximum flow rate through the respective valves. In other examples, the first and second expansion valves 222, 223 do not significantly restrict a flow of refrigerant therethrough when open. In some such examples, the first and second expansion valves 222, 223 are positioned upstream or downstream of respective further expansion valves for providing such a restriction, or are positioned, in use, downstream of any other expansion valve for providing such a restriction, such as an expansion valve of the refrigeration system 101, which may be upstream of the inlet arrangement 220. In this way, an expansion of the first refrigerant to a lower pressure and/or temperature may be achieved using expansion valves other than the first and second expansion valves 222, 223, and the first and second expansion valves 222, 223 may be operably merely to direct a flow of refrigerant, in use. In other words, in some examples, the inlet arrangement 220 and/or the heat exchanger arrangement 200 as a whole does not comprise an expansion valve configured to expand a refrigerant flowing therethrough.

In other examples, the first and second expansion valves 222, 223 are instead replaced with a single a selector valve and/or directional control valve (not shown). The selector valve and/or directional control valve is operable to direct the first fluid from the first-fluid inlet 221 to either the first opening 224*a* or the second opening 224*b*. In some examples, in use, the selector valve and/or directional control valve is fluidically coupled downstream of a further expansion valve for causing an expansion of the first refrigerant to a lower pressure and/or temperature, which may be a further expansion valve of the inlet arrangement 220, or a further expansion valve of the refrigeration system 101. The further expansion valve may be upstream of the first-fluid inlet 221 and/or the inlet arrangement 220 as a whole, as discussed above.

In the illustrated example, the heat exchanger arrangement 200 comprises an outlet arrangement 230 comprising a first-fluid outlet 232 that is fluidically coupled to the first flow path 211, and through which the first refrigerant can flow out of the heat exchanger 210, in use. The outlet arrangement 230 specifically comprises a first outlet opening 234*a* into the first flow path 211 and a second outlet opening 234*b* into the first flow path 211. The first and second outlet openings 234*a*, 234*b* are fluidically coupled to the first-fluid outlet 232, so that the first fluid can flow from the first and second outlet openings to the first-fluid outlet, in use.

In other words, the first flow path 211 is fluidically coupled between the first-fluid inlet 221 and the first-fluid outlet 232. The heat exchanger arrangement 200 also comprises a second-fluid inlet 241 and a second-fluid outlet 242. The second flow path 212 is fluidically coupled between the second-fluid inlet 241 and the second-fluid outlet 242. In some examples, the heat exchanger arrangement 200 comprises a further inlet arrangement (not shown), similar to the inlet arrangement 220, that is configured to control flow of the second refrigerant from the second-fluid inlet 241 to the second flow path 212, such as where the heat exchanger 210 comprises plural openings into the second flow path 212.

The heat exchanger arrangement 200 also comprises a controller 300 configured to cause operation of the inlet arrangement 220 to control flow of the first refrigerant from the first-fluid inlet 221 to the first opening 224*a* and to the second opening 224*b*. Specifically, the controller 300 is configured to cause operation of the first and second expansion valves 222, 223 to provide the functionality described above. In other examples, the controller 300 is a part of the refrigeration system 100, and/or is an external controller 300 that is communicatively coupled, such as via a wired or wireless connection, to the heat exchanger arrangement 200, and specifically the inlet arrangement 220. An example operation of the controller 300 will be described in more detail below, with reference to FIG. 3 and the method 400 shown and described in relation to FIG. 4.

Turning briefly to the example refrigeration system 100 in which the heat exchanger arrangement 200 of the illustrated example is installed, the refrigeration system 100 comprises a first compressor 121 fluidically coupled in the first refrigeration cycle 101 and configured to increase a pressure and temperature of the first refrigerant. The refrigeration system 100 also comprises a second compressor 122 fluidically coupled in the second refrigeration cycle 102 and configured to increase a pressure and temperature of the second refrigerant.

The refrigeration system 100 comprises a condenser 131 fluidically coupled in the first refrigeration cycle 101 downstream of the first compressor 121 and upstream of the first-fluid inlet 221. That is, in the illustrated example, the heat exchanger arrangement 200 is fluidically coupled in the refrigeration system 100 such that the first-fluid inlet 221 receives refrigerant from the condenser 131. The condenser 131 is configured to transfer heat, in use, between the first refrigerant flowing therethrough and a first external fluid, which may for example an ambient atmosphere surrounding the condenser, as described in more detail below, in relation to a storage unit 10 in which the refrigeration system 100 can be employed in various examples. This is to condense some or all of the first-cycle refrigerant into a liquid phase.

The first refrigerant from the condenser 131 is then supplied to, and expanded to a vaporous state through, an expansion valve, as described above. Specifically, in the illustrated example, the refrigerant from the condenser 131 is supplied to the first-fluid inlet 221 and expanded through one or both of the first and second expansion valves 222, 223. The expanded first refrigerant is then passed through the first flow path 211 of the heat exchanger 211, before being returned to the compressor 121 through the first-fluid outlet 232. Expanding the first refrigerant through the first and/or second expansion valve 222, 223 reduces a temperature of the refrigerant flowing through the first flow path 211.

In use, the first refrigerant flowing through the first flow path 211 is at a lower temperature than the refrigerant flowing through the second flow path 212, which is fluidically coupled to receive relatively high-pressure and high-temperature gaseous refrigerant from the second compressor 122. In this way, a transfer of heat from the second refrigerant in the second flow path to the first refrigerant in the first flow path in the heat exchanger 210 causes some or all of the first refrigerant to evaporate into a gaseous state, and causes some or all of the second refrigerant to condense into a liquid state. The heat exchanger 210 thereby functions as an evaporator for the first refrigeration cycle 101 and a condenser for the second refrigeration cycle 102. It will be appreciated that, in some examples, the refrigeration system 100 and/or the heat exchanger arrangement 200 is operable so that the first refrigerant is superheated above its saturation temperature at a pressure in the first flow path 211, in use, such as to provide fully gaseous refrigerant to the first compressor 121. In other examples, the refrigeration system 100 and/or the heat exchanger arrangement 200 is operable so that the second refrigerant is subcooled below its saturation temperature at a pressure in the second flow path 212, in use.

The second refrigeration cycle 102 comprises a second-cycle expansion valve 140 downstream of the second flow path 212 and upstream of the second compressor 122. The second refrigeration cycle 102 further comprises an evaporator 132 downstream of the second-cycle expansion valve 140 and upstream of the second compressor 122. The second-cycle expansion valve 140 is configured, in use, to cause an expansion of the second refrigerant received from the second flow path, most or all of which is in a liquid phase, to a lower temperature and pressure vaporous refrigerant. The expanded second refrigerant is then passed to the evaporator 132, which is configured to exchange heat between the second refrigerant and a second external fluid which is passed through, or across, the evaporator 132, in use. The evaporated second refrigerant, which is in some examples superheated through the evaporator 132, is then passed back to the second compressor 122. The second external fluid is here a gas received from and/or to be supplied to a cargo space 12 in a storage unit 10, which is now described in more detail with reference to FIG. 2.

Figure 2:
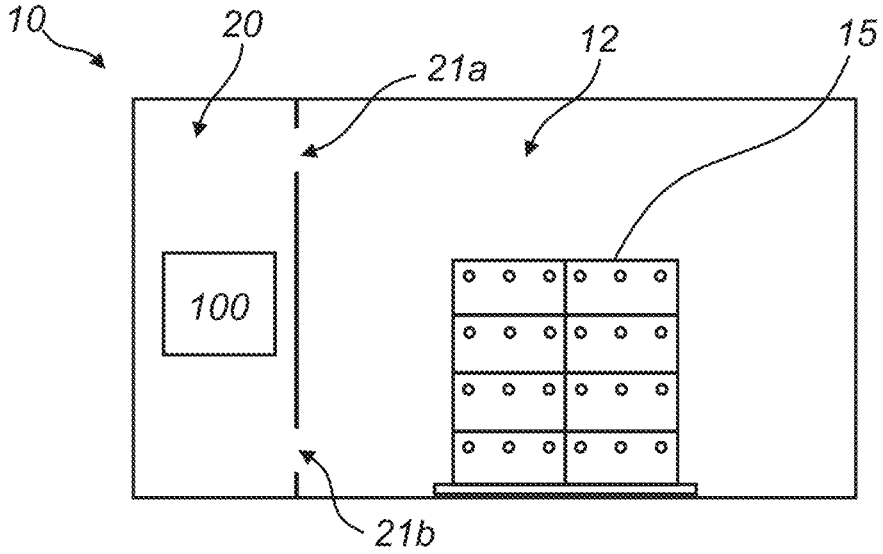
FIG. 2 shows a schematic view of an example storage unit comprising the refrigeration system shown in FIG. 1.

Specifically, as shown in FIG. 2, the refrigeration system 100 is, in various examples, configured for use in a storage unit 10. The storage unit 10 of the illustrated example is a transport unit 10, such as a reefer container or refrigerated truck or trailer, but in other examples the storage unit 10 may be any other suitable storage unit, such as a storage unit in a warehouse.

The storage unit comprises a cargo space 12 for storing cargo 15, and an atmosphere control system 20 for controlling an atmosphere in the cargo space 12. The cargo 15 in the illustrated example is fresh or frozen produce. This may include respirating and/or ripenable produce, such as fruit and vegetables, and/or non-respirating fresh or frozen produce, such as meat and/or fish. In other examples, the storage unit 10 is for transporting any other suitable cargo 15, for example medicaments, such as vaccines. It will be appreciated, however, that the cargo 15 may be any other suitable cargo 15, and may advantageously be cargo 15 that requires, or benefits from, being stored in an atmosphere-controlled cargo space 12.

The atmosphere control system 20 is configured to supply conditioned gas, such as cooled or heated gas, or gas with a specific composition, into the cargo space 12, such as through one or both of a first port 21*a* and a second port 21*b* that each open into the cargo space 12, or via any other suitable fluidic connection between the atmosphere control system 20 and the cargo space 12. In other examples, the atmosphere control system 20, or a part thereof, is located in the cargo space 12.

The atmosphere control system comprises the refrigeration system 100. Specifically, the evaporator 132 of the refrigeration system 100 is located so that the second external fluid is gas to be supplied to the cargo space 12, which in some examples is recirculated gas received from the cargo space 12. That is, the atmosphere control system 20 may comprise a fluid moving device for moving the gas from, and/or to be supplied to, the cargo space 12 across the evaporator 132, so that the second-cycle refrigerant in the evaporator 132 can be used to cool the gas.

Figure 3:
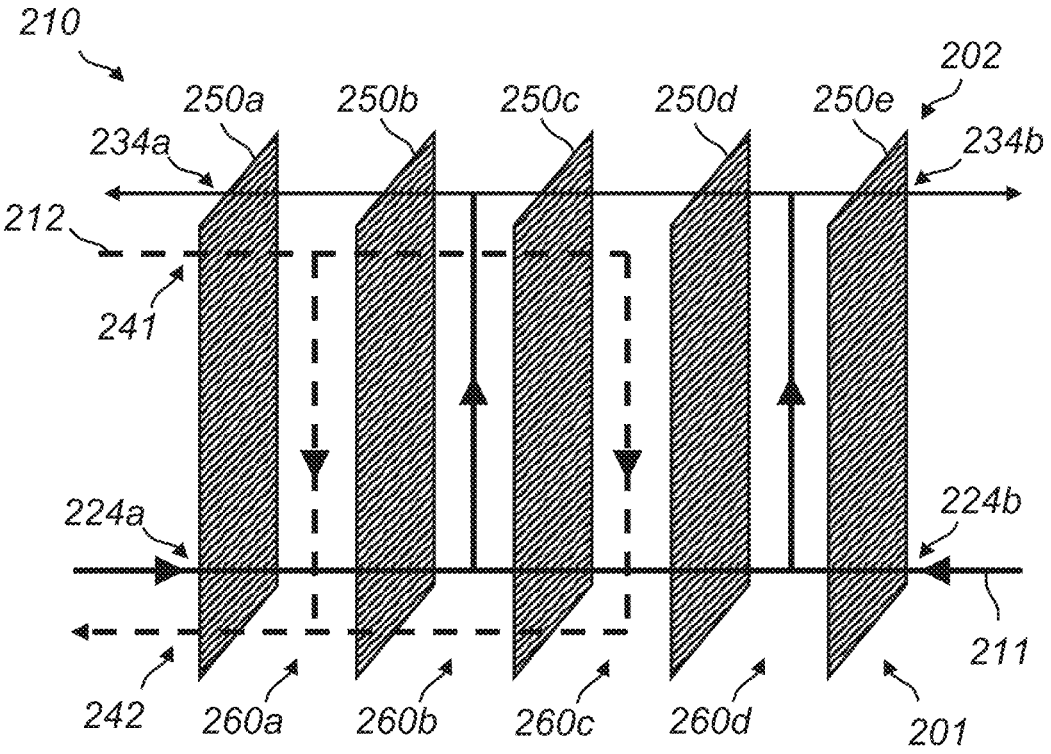
FIG. 3 shows a schematic exploded view of an example plate heat exchanger.

Turning now to FIG. 3, the heat exchanger arrangement 200 is described in more detail. FIG. 3 shows a schematic exploded view of the heat exchanger 210, which here is a plate heat exchanger 210. The heat exchanger 210 comprises a plurality of plates 250*a* to 250*e* arranged parallel to one another in a laminar, or stacked, arrangement. The heat exchanger 210 specifically comprises first to fifth plates 250*a* to 250*e* configured to define respective cavities 260*a* to 260*d* between each adjacent pair of the plates 250*a* to 250*e*. In this way, a first cavity 260*a* is defined between the first and second plates 250*a*, 250*b*, a second cavity 260*b* is defined between the second and third plates 250*b*, 250*c*, and so on. First to fourth cavities 260*a* to 260*d* are shown in FIG. 3.

The first flow path 211 through the heat exchanger 210 is shown as a solid black line in FIG. 3, while the second flow path 212 is shown as a dashed black line. As shown, the heat exchanger 210 is configured so that the first refrigerant is able to flow along the first flow path 211 from the first opening 224*a* and/or the second opening 224*b* to the first outlet opening 234*a* and/or the second outlet opening 234*b* via the second and fourth cavities 260*b*, 260*d*. That is, the second and fourth cavities 260*b*, 260*d* together form a single identifiable volume defining the first flow path between the first and second openings 224*a*, 224*b* and the first and second outlet openings 234*a*, 234*b*. The second refrigerant is able to pass along the second flow path 212 from the second-fluid inlet 241 to the second-fluid outlet 242 via the first and third cavities 260*a*, 260*c*. That is, the first and third cavities 260*a*, 260*c* together form a single identifiable volume defining the first flow path between the second-fluid inlet 241 and the second-fluid outlet 242. In this way, the heat exchange interface 213 is defined by the plural internal plates 250*b* to 250*d* (i.e. excluding the first and fifth plates 250*a*, 250*e*, which are endplates). It will be appreciated that the first and third cavities 260*a*, 260*c* may define a first "side" of the heat exchanger 210, while the second and fourth cavities 260*b*, 260*d* define a second "side". In some examples, the plates 250*a* to 250*e* are shaped so as to define plural fluid flow pathways, or channels, within each cavity. It will also be appreciated that the heat exchanger 210 in other examples comprises any suitable number of plates, such as up to 20 plates, up to 40 plates, up to 60 plates, up to 80 plates, or more than 80 plates. Increasing a number of plates may increase a heat exchange capacity of the heat exchanger, such as due to a larger overall heat exchange interface 113.

In the illustrated example, the first and second openings 224*a*, 224*b* each open into the second and fourth cavities 260*b*, 260*d* at respective first ends 201 of the second and fourth cavities 260*b*, 260*d*, which here correspond to respective first ends 201 of the plates 250*a* to 250*c*. The first and second outlet openings 234*a*, 234*b* each opens into the second and fourth cavities 260*b*, 260*d* at respective second, opposite ends 202 of the second and fourth cavities 260*b*, 260*d*, which here correspond to respective second ends 202 of the plates 250*a*, 250*c*, opposite to the respective first ends 201 of the plates 250*a* to 250*c*, specifically in a longitudinal dimension of the plates 250*a* to 250*e*. The second-fluid inlet 241 opens into the first and third cavities 260*a*, 260*c* at respective second ends 202 of the first and third cavities 260*a*, 260*c*, which correspond to the respective second ends 202 of the plates 250*a*, 250*c*. The second-fluid outlet 242 opens into the first and third cavities 260*a*, 260*c* at respective first ends 201 of the first and third cavities 260*a*, 260*c*, which correspond to the respective first ends 201 of the plates 250*a*, 250*c*. In this way, a contra-flow of refrigerant in the first and second flow paths 211, 212 is achieved. It will be appreciated that, in other examples, the first and second openings 224*a*, 224*b*, the first and second outlet openings 234*a*, 234*b*, the second-fluid inlet 241 and/or the second-fluid outlet 242 may open into the respective cavities 260*a* to 260*d* at any other suitable location. For example, refrigerant in both the first and second flow paths 211, 212 may flow in the same longitudinal direction through the heat exchanger 210, and/or may flow across the heat exchanger 210 in a lateral direction, perpendicular to the longitudinal direction, or in any other suitable direction.

As noted above, the heat exchanger 210 comprises a first endplate 250*a*, which here is the first plate 250*a*, being the first plate in the series of plates 250*a* to 250*d*, and a second endplate 250*e*, which here is the fifth plate 250*e*, being the last plate in the series of plates 250*a* to 250*c*. The first opening 224*a* opens into the first flow path 211 in proximity to, specifically through, the first endplate 250*a*, and the second opening 224*b* opens into the first flow path 211 in proximity to, specifically through, the second endplate 250*e*. Similarly, the first outlet opening 234*a* opens into the first flow path 211 in proximity to, specifically through, the first endplate 250*a*, and the second outlet opening 234*b* opens into the first flow path 211 in proximity to, specifically through, the second endplate 250*e*. It will be appreciated that, in other examples, the first and second openings 224*a*, 224*b* and/or the first and second outlet openings 234*a*, 234*b* open into the first flow path 211 in any other suitable location, such as in proximity to opposite lateral or longitudinal sides, or edges, of the same endplate, such as the first or the second endplate 250*a*, 250*c*.

Figure 4:
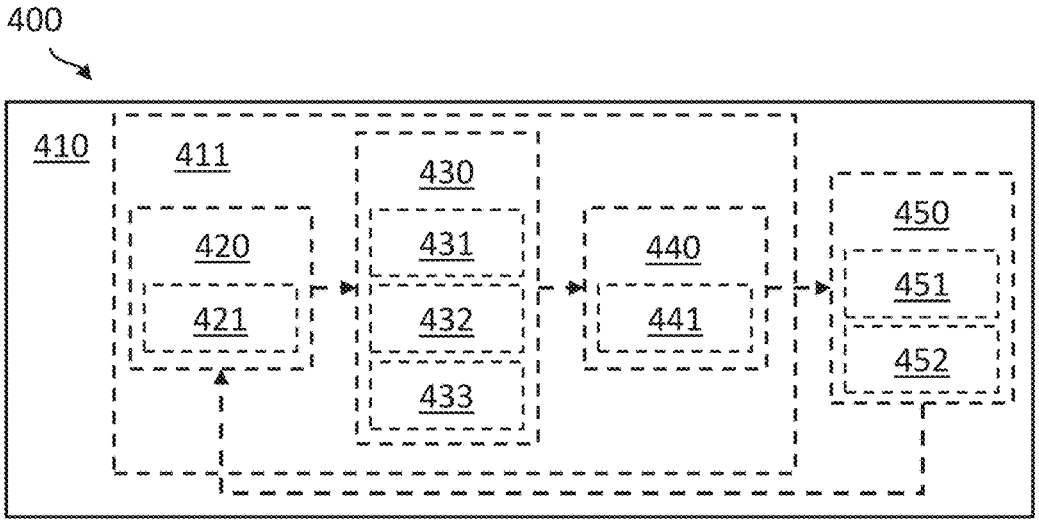
FIG. 4 shows an example method of controlling the heat exchanger arrangement shown in FIG. 1.

Turning now to FIG. 4, shown is an example method 400 of controlling and/or causing operation of the heat exchanger arrangement 200. The method 400 is, in the illustrated example, performed by the controller 300 described above, specifically by the controller 300 causing operation of the first and second expansion valves 222, 223, although in other examples it may be performed by any other suitable controller and/or by a human operator.

The method 400 comprises controlling 410 flow of the first refrigerant from the first-fluid inlet to the first opening and to the second opening. More specifically, the controlling 410 the flow of the first refrigerant comprises alternately causing 411 the first refrigerant to flow in a first mode and in a second mode, such as by alternately causing 411 operation of the inlet arrangement 220 in the first and second modes. The method 400 comprises, in the first mode, causing 421 the first refrigerant to flow from the first-fluid inlet 221 to the first opening 224*a*, and in the second mode, causing 441 the second refrigerant to flow from the first-fluid inlet 221 to the second opening 224*b*. This is specifically by the controller 300 causing the first and second expansion valve 222, 223 to alternately open and close. By alternately switching between the first and second modes, the first refrigerant is supplied alternately to opposite sides of the heat exchanger 210.

With reference to FIG. 3, this can vary a distribution of the first refrigerant in the second and fourth cavities 260*b*, 260*d*, and thereby a distribution of the first refrigerant over the second to fifth plates 250*b*, 250*e*, in use. This is particularly advantageous where the first refrigerant is supplied as a vapour, in which a density of the liquid-phase refrigerant in the vapour is higher than a density of the gas-phase refrigerant in the vapour. For example, where the first refrigerant is supplied through the first opening 224*a*, a higher proportion of the heavier liquid-phase portion of the first refrigerant may pass through the fourth cavity 260*d* than through the second cavity 260*b*, under the effect of momentum. This may cause an uneven distribution, and/or stratification, of liquid refrigerant in the first flow path 211. Similarly, supplying the first refrigerant through the second opening 224*b* may result in a higher proportion of liquid-phase refrigerant passing through the second cavity 260*b* than through the fourth cavity 260*d*. If the refrigerant were to be passed through the first and second openings 224*a*, 224*b* simultaneously, then a higher proportion of liquid-phase refrigerant may be present in cavities 260*b* in the middle of the heat exchanger 210 than in cavities 260*d* that are closer to the endplates 250*a*, 250*e*, particularly as a number of plates 250*a* to 250*e* in the heat exchanger 210 is increased.

By supplying the first refrigerant alternately through the first and second openings 224*a*, 224*b*, the liquid refrigerant may be better distributed between the second and fourth cavities 260*b*, 260*d* and, more generally, across all cavities in the first flow path 211. This can provide a greater proportion of liquid-phase refrigerant in contact with the plates 250*a* to 250*e* of the heat exchanger 210, thereby improving a heat transfer capacity across the heat exchange interface 113.

In the present example, the method comprises causing 431, for a period when switching between the first mode and the second mode, the first refrigerant to be supplied from the first-fluid inlet to the first and second openings at the same time. This is specifically by causing, such as by the controller 300 causing, operation of the inlet arrangement 220 to cause both of the first and second expansion valves 222, 223 to be open simultaneously. More specifically, this is by causing, during the switching, the first expansion valve 222 to open before the second expansion valve 223 is closed, and/or by causing the first expansion valve 222 to open before the second expansion valve 223 is closed. In other examples, where the first and second expansion valves 222, 223 are instead variable flow control valves as described above, the method 400 may comprise causing, such as by the controller 300 causing, the second valve 223 to gradually open as the first valve 222 is gradually closed, and/or by causing 431 the first valve 222 to gradually open as the second valve 223 is gradually closed.

In other examples, the method 400 comprises, for the period when switching between the first and second modes, preventing 432 a flow of the first refrigerant from the first-fluid inlet 221 to both the first and second openings 224*a*, 224*b*. This is specifically by the controller 300 causing both the first and second expansion valves 222, 223 to close for the period when switching between the first and second modes.

In other words, more broadly, in the illustrated example the method 400 comprise causing 430, for the period when switching between the first and second modes, operation of the inlet arrangement 220 in a third mode in which the first and second expansion valves 222 are either both open or both closed. In other examples, the method 400 comprises causing 433 the inlet arrangement 220 to operate in the second mode immediately after operating in the first mode, and/or to operate in the first mode immediately after operating in the second mode, i.e. without such a third mode.

Figure 5A:
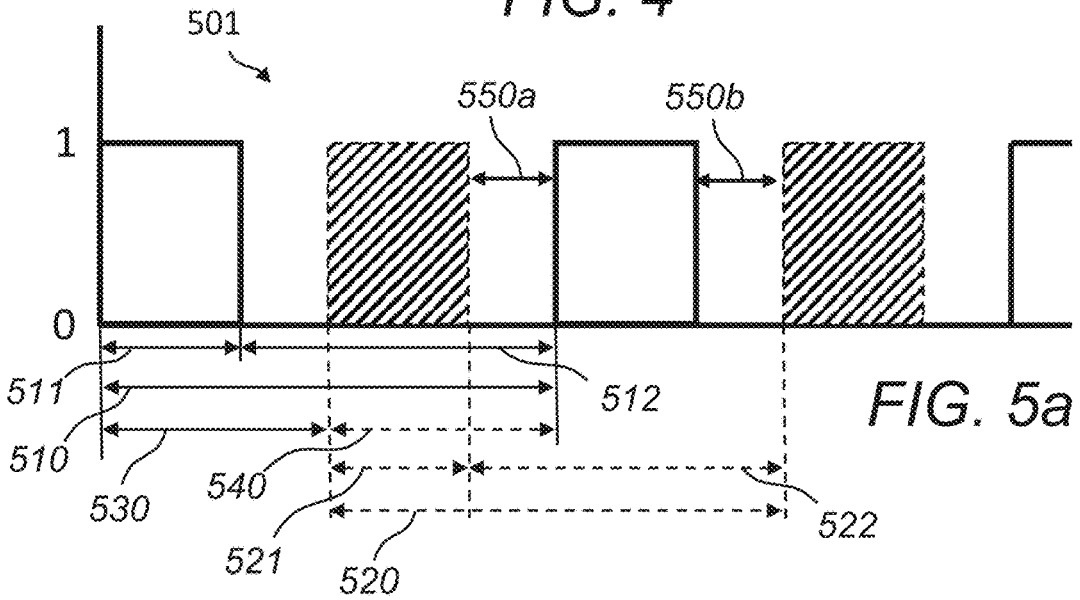
FIGS. 5*a* and 5*b* show charts of example operations of the heat exchanger arrangement shown in FIG. 1.
Figure 5B:
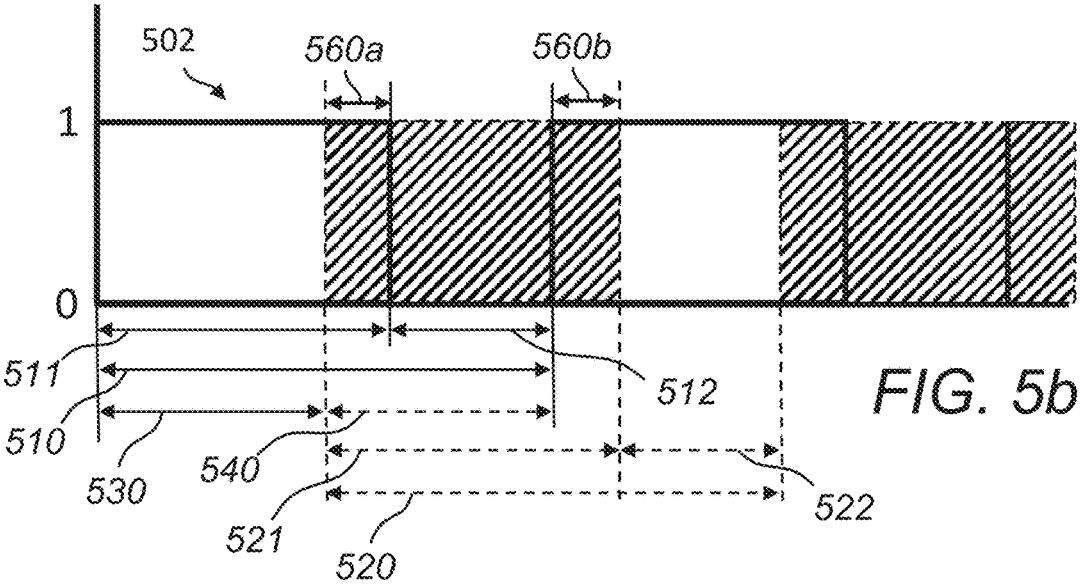

We now turn to FIGS. 5*a* and 5*b*, which are charts 501, 502 showing example states of the first expansion valve 222 (solid line, 501) and the second expansion valve 223 (dashed line, 502) over time during operation of the inlet arrangement 220 according to examples of the method 400. A value of one in the charts of FIGS. 5*a* and 5*b* indicates that the respective expansion valve 222, 223 is open, while a value of zero indicates that the respective expansion valve 222, 223 is closed. For clarity, periods where the second expansion valve 223 is open are highlighted with hatching beneath the dashed curve.

The alternately causing 411 operation of the inlet arrangement 220 in the first and second modes more specifically comprises causing 420 operation of the inlet arrangement 220, and specifically the first expansion valve 222, in a repeating first cycle having a first cycle period 510, and causing 440 operation of the inlet arrangement 220, and specifically the second expansion valve 223, in a repeating second cycle having a second cycle period 520. During a first on-period 511, defining a start of the first cycle, the first expansion valve 222 is open, and during a first off-period 512, defining a remainder of the first cycle, the first expansion valve 222 is closed. Similarly, during a second on-period 521, defining a start of the second cycle, the second expansion valve 223 is open, and during a second off-period 522, defining a remainder of the second cycle, the second expansion valve 223 is closed. In other words, the first cycle period 510 is a sum of the first on-period 511 and the first off-period 512, and the second cycle period 520 is a sum of the second on-period 521 and the second off-period 522. In this way, the method 400 comprises causing 421 operation of the inlet arrangement 220 in the first mode for at least a part of the first cycle period 510 and causing 441 operation of the inlet arrangement 220 in the second mode for at least a part of the second cycle period 520.

More specifically, the causing 420, 440 operation of the first and second expansion valves 222, 223 in the repeating first and second cycles is such that that a first delay 530 between the start of the first cycle and the start of the second cycle is half of the first cycle period 510, and so that a second delay 540 between the start of the second cycle and the start of the first cycle is half of the second cycle period 520. That is, the method 400 comprises causing 420, 440 operation of the first and second expansion valves 222, 223 so that the second cycle begins halfway through the first cycle period 510, and so that the first cycle begins halfway through the second cycle period 520.

As shown in FIGS. 5*a* and 5*b*, the first cycle period 510 is the same as the second cycle period 520. That is, the first and second cycles periods 510, 520 have a common cycle period. In this way, the first and second cycles are synchronised so as to be temporally offset by half of the common cycle period. This provides a more regular and even supply of the first fluid to the first and second openings 224*a*, 224*b*.

In a first example, as shown in FIG. 5*a*, the first on-period 511 is shorter than the first off-period 512, and the second on-period 521 is shorter than the second off-period 522. In this way, the first and second off-periods 512, 522 overlap for an overlapping off-period 550*a*, 550*b* at the respective ends of the repeating first and second cycles. The first and second expansion valves 222, 223 are both closed during the overlapping off-period 550*a*, 550*b*. In this way, in the first example, the method 400 comprises causing 420 operation of the inlet arrangement 220 in the third mode during the overlapping off-period 550*a*, 550*b*. Specifically, this is by the method 400 comprising causing 432 the inlet arrangement 220 to operate in the second mode a period of time after completion of operating in the first mode, and to operate in the first mode a period of time after completion of operating in the second mode, the period of time corresponding to the overlapping off-period 550*a*, 550*b*. As shown in FIG. 5*b*, this leads to periods of time where there is no refrigerant supplied to the first flow path 211. This may reduce an amount of heat exchanged between the first and second refrigeration cycles 101, 102 using the heat exchanger 210, which may be desirable during periods of relatively low cooling demand from the refrigeration system 100 compared to a maximum achievable cooling capacity of the refrigeration system 100.

In a second example, as shown in FIG. 5*b*, the first on-period 511 is longer than the first off-period 512, and the second on-period 521 is longer than the second off-period 522. In this way, the first and second on-periods 511, 521 overlap for an overlapping on-period 560*a*, 560*b* at the respective starts of the repeating first and second cycles. The first and second expansion valves 222, 223 are both open during the overlapping on-period 560*a*, 560*b*. In this way, in the second example, the method 400 comprises causing 420 operation of the inlet arrangement 220 in the third mode during the overlapping on-period 560*a*, 560*b*. Specifically, this is by the method 400 comprising causing 431 operation of the inlet arrangement 220 so that the first and second expansion valves 222, 223 are open simultaneously during the overlapping on-period 560*a*, 560*b*. As shown in FIG. 5*b*, this may result in refrigerant always being supplied to the first flow path 211. This may increase an amount of heat exchanged between the first and second refrigeration cycles 101, 102 using the heat exchanger 210, which may be desirable during periods of relatively high cooling demand from the refrigeration system 100 compared to a maximum achievable cooling capacity of the refrigeration system 100.

In some examples, the method 400 comprises varying 450 any one or more of the first on-period, the first off-period, the second on-period and the second off-period, such as to control a total amount of refrigerant supplied to the first flow path 211, in use. In some such examples, the method 400 comprises maintaining 451 the first and second cycle periods, but in other examples the method 400 comprises varying 452 the first and/or the second cycle period.

Figure 6:
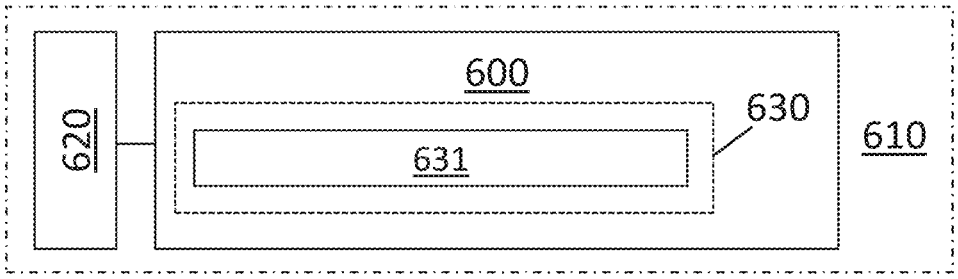
FIG. 6 shows an example non-transitory computer readable storage medium.

FIG. 6 shows a schematic diagram of a non-transitory computer-readable storage medium 600 according to an example. The non-transitory computer-readable storage medium 600 stores instructions 630 that, if executed by a processor 620 of a controller 610, cause the processor 620 to perform a method according to an example. In some examples, the controller 610 is the controller 300 as described above or any variation thereof discussed herein. The instructions 630 comprise controlling 631 flow of the first refrigerant from the first-fluid inlet 221 to the first opening 224*a* and to the second opening 224*b*. In other examples, the instructions 630 comprise instructions to perform any other example method described herein, such as the method 400 described above with reference to FIG. 4. In some examples, the refrigeration system 100 and/or the atmosphere control system 20, and/or the storage unit 10 comprises the non-transitory computer-readable storage medium 600.

Figure 7:
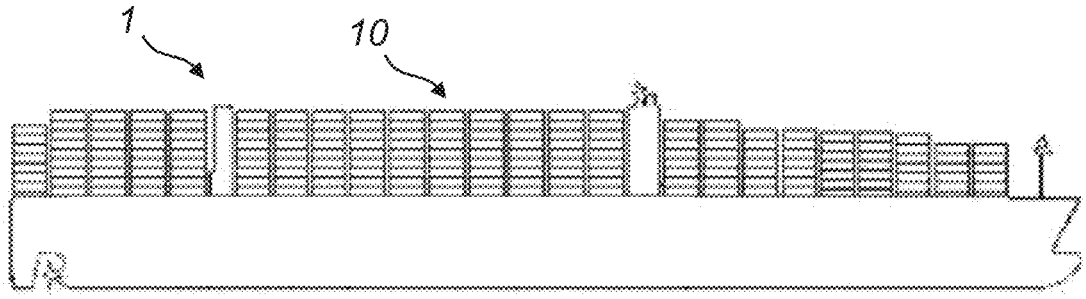
FIG. 7 shows an example marine vessel comprising the storage unit shown in FIG. 2.

FIG. 7 shows an example marine vessel 1, which here is a container ship. The marine vessel 10 comprises, and is configured to transport, the storage unit 10. In other examples, the marine vessel 10 comprises the controller 300, the non-transitory computer-readable storage medium 600, and/or the refrigeration system 100.

Example embodiments of the present invention have been discussed, with particular reference to the examples illustrated. However, it will be appreciated that variations and modifications may be made without departing from the scope of the invention as defined by the appended claims. For example, it will be understood that any of the method 400 actions described above may be performed by the controller 300, such as by the controller 300 causing operation of the heat exchanger arrangement 200, and specifically the inlet arrangement 220, to achieve the desired functionality.

Furthermore, although a heat exchanger arrangement 200 is described herein in relation to a refrigeration system 100, and specifically a cascade refrigeration system for a storage unit, it will be appreciated that the heat exchanger arrangement 200 may be used in any other suitable refrigeration system 100. By way of non-liming example, the heat exchanger arrangement 200 may be used in a single-cycle refrigeration system for a storage unit, an industrial refrigeration system, such as in a supermarket or vaccination facility, a domestic refrigeration system, and/or a refrigeration system in a vehicle, such as an automobile, train, truck and/or aircraft. Moreover, it will be appreciated that, where the heat exchanger arrangement 200 is used in a refrigeration system for a storage unit, the storage unit may be, for instance, a transport unit, such as a reefer container or refrigerated truck or trailer, or may be a storage unit in, for example, a warehouse, such as in a cold-storage warehouse and/or ripening warehouse for ripening produce.

What is claimed is:

1. A heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path; and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the inlet arrangement is operable to control flow of the first fluid from the first-fluid inlet to the first opening and to the second opening.

2. The heat exchanger arrangement of claim 1, wherein the inlet arrangement comprises a first valve operable to selectively fluidically couple the first-fluid inlet to the first opening, and a second valve operable to selectively fluidically couple the first-fluid inlet to the second opening.

3. The heat exchanger arrangement of claim 1, wherein the inlet arrangement comprises an expansion valve.

4. The heat exchanger arrangement of claim 1, wherein the first flow path comprises a plurality of fluid flow cavities, and wherein the first and second openings both open into each of the plurality of fluid flow cavities.

5. The heat exchanger arrangement of claim 1, comprising a controller configured to cause operation of the inlet arrangement to control flow of the first fluid from the first-fluid inlet to the first opening and to the second opening.

6. The heat exchanger arrangement of claim 5, wherein the controller is configured to cause operation of the inlet arrangement alternately in a first mode and a second mode, wherein, in the first mode, the first fluid is caused to flow from the first-fluid inlet to the first opening, and in the second mode, the first fluid is caused to flow from the first-fluid inlet to the second opening.

7. The heat exchanger arrangement of claim 6, wherein the controller is configured to cause, for a period when switching between the first mode and the second mode, operation of the inlet arrangement so that the first fluid is supplied from the first-fluid inlet to the first and second openings at the same time.

8. A method of controlling a heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path, and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the method comprises controlling flow of the first fluid from the first-fluid inlet to the first opening and to the second opening.

9. The method of claim 8, comprising causing operation of the inlet arrangement alternately in a first mode and a second mode, wherein, in the first mode, the first fluid is caused to flow from the first-fluid inlet to the first opening, and in the second mode, the first fluid is caused to flow from the first-fluid inlet to the second opening.

10. The method of claim 9, comprising causing, for a period when switching between the first mode and the second mode, operation of the inlet arrangement so that the first fluid is supplied from the first-fluid inlet to the first and second openings at the same time.

11. The method of claim 8, comprising causing operation of the inlet arrangement in:

a repeating first cycle so that, during a first on-period defining a start of the first cycle, the first fluid is caused to flow from the first-fluid inlet to the first opening, and during a first off-period defining a remainder of the first cycle, the first fluid is prevented from flowing from the first-fluid inlet to the first opening; and a repeating second cycle so that, during a second on-period defining a start of the second cycle, the first fluid is caused to flow from the first-fluid inlet to the second opening, and during a second off-period defining a remainder of the second cycle, the first fluid is prevented from flowing from the first-fluid inlet to the second opening;

wherein the first cycle has a first cycle period, which is a sum of the first on-period and the first off-period, and the second cycle has a second cycle period, which is a sum of the second on-period and the second off-period.

12. The method of claim 11, wherein the first cycle period is the same as the second cycle period.

13. The method of claim 11 comprising causing operation of the inlet arrangement so that the second cycle begins halfway through the first cycle period, and so that the first cycle begins halfway through the second cycle period.

14. A controller configured to perform operations comprising:

controlling flow of a first fluid of a refrigeration system, the refrigeration system comprising:

a heat exchanger comprising a first flow path, a second flow path, and one or more heat exchange surfaces configured to transfer heat between the first fluid in the first flow path and a second fluid in the second flow path, and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the controlling comprises controlling flow of the first fluid from the first-fluid inlet to the first opening and to the second opening.

15. A non-transitory computer-readable storage medium storing instructions that, when executed by a processor, cause the processor to perform operations comprising:

controlling flow of a first fluid of a refrigeration system, the refrigeration system comprising:

a heat exchanger comprising a first flow path, a second flow path, and one or more heat exchange surfaces configured to transfer heat between the first fluid in the first flow path and a second fluid in the second flow path, and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the controlling comprises controlling flow of the first fluid from the first-fluid inlet to the first opening and to the second opening.

16. A refrigeration system comprising:

a heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path, and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the inlet arrangement is operable to control flow of the first fluid from the first-fluid inlet to the first opening and to the second opening; and a controller configured to control flow of the first fluid from the first-fluid inlet to the first opening and to the second opening.

17. An assembly, comprising:

a transport unit comprising:

a heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path, and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the inlet arrangement is operable to control flow of the first fluid from the first-fluid inlet to the first opening and to the second opening; and a controller configured to control flow of the first fluid from the first-fluid inlet to the first opening and to the second opening.

18. An assembly, comprising:

a marine vessel comprising:

a heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path, and an inlet arrangement comprising a first-fluid inlet for receiving the first fluid from a source, a first opening into the first flow path, and a second opening into the first flow path, the first and second flow paths each comprising a respective volume through which fluid can flow, and the first opening and the second opening each open into the same volume;

wherein the inlet arrangement is operable to control flow of the first fluid from the first-fluid inlet to the first opening and to the second opening; and a controller configured to control flow of the first fluid from the first-fluid inlet to the first opening and to the second opening.

19. A heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path; and an inlet arrangement comprising a first-fluid inlet for receiving the first fluid from a source, a first opening into the first flow path, and a second opening into the first flow path, the first flow path comprising a plurality of fluid flow cavities, the first and second openings both opening into each of the plurality of fluid flow cavities;

wherein the inlet arrangement is operable to control flow of the first fluid from the first-fluid inlet to the first opening and to the second opening.

20. The heat exchanger arrangement of claim 1, comprising a controller configured to cause operation of the inlet arrangement to control flow of the first fluid from the first-fluid inlet to the first opening and to the second opening.

21. The heat exchanger arrangement of claim 5, wherein the controller is configured to cause operation of the inlet arrangement alternately in a first mode and a second mode, wherein, in the first mode, the first fluid is caused to flow from the first-fluid inlet to the first opening, and in the second mode, the first fluid is caused to flow from the first-fluid inlet to the second opening.

22. The heat exchanger arrangement of claim 6, wherein the controller is configured to cause, for a period when switching between the first mode and the second mode, operation of the inlet arrangement so that the first fluid is supplied from the first-fluid inlet to the first and second openings at the same time.

23. A heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path;

an inlet arrangement comprising a first-fluid inlet for receiving the first fluid from a source, a first opening into the first flow path, and a second opening into the first flow path; and a controller configured to cause operation of the inlet arrangement to control flow of the first fluid from the first-fluid inlet to the first opening and to the second opening, the controller configured to cause operation of the inlet arrangement alternately in a first mode and a second mode, wherein, in the first mode, the first fluid is caused to flow from the first-fluid inlet to the first opening, and, in the second mode, the first fluid is caused to flow from the first-fluid inlet to the second opening.

24. The heat exchanger arrangement of claim 23, comprising a controller configured to cause operation of the inlet arrangement to control flow of the first fluid from the first-fluid inlet to the first opening and to the second opening.

25. The heat exchanger arrangement of claim 24, wherein the controller is configured to cause operation of the inlet arrangement alternately in a first mode and a second mode, wherein, in the first mode, the first fluid is caused to flow from the first-fluid inlet to the first opening, and in the second mode, the first fluid is caused to flow from the first-fluid inlet to the second opening.

26. The heat exchanger arrangement of claim 25, wherein the controller is configured to cause, for a period when switching between the first mode and the second mode, operation of the inlet arrangement so that the first fluid is supplied from the first-fluid inlet to the first and second openings at the same time.

27. A method of controlling a heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path, and an inlet arrangement comprising a first-fluid inlet for receiving the first fluid from a source, a first opening into the first flow path, and a second opening into the first flow path;

wherein the method comprises controlling flow of the first fluid from the first-fluid inlet to the first opening and to the second opening; and controlling the inlet arrangement alternately in a first mode and a second mode, wherein, in the first mode, the first fluid is caused to flow from the first-fluid inlet to the first opening, and, in the second mode, the first fluid is caused to flow from the first-fluid inlet to the second opening.

28. The method of claim 27, further comprising operating the inlet arrangement to control flow of the first fluid from the first-fluid inlet to the first opening and to the second opening.

29. The method of claim 27, further comprising causing, for a period when switching between the first mode and the second mode, operation of the inlet arrangement so that the first fluid is supplied from the first-fluid inlet to the first and second openings at the same time.

30. A method of controlling a heat exchanger arrangement for a refrigeration system, the heat exchanger arrangement comprising:

a heat exchanger comprising a first flow path, a second flow path, and one or more heat exchange surfaces configured to transfer heat between a first fluid in the first flow path and a second fluid in the second flow path, and an inlet arrangement comprising a first-fluid inlet for receiving the first fluid from a source, a first opening into the first flow path, and a second opening into the first flow path;

wherein the method comprises controlling flow of the first fluid from the first-fluid inlet to the first opening and to the second opening; and controlling the inlet arrangement in:

a repeating first cycle so that, during a first on-period defining a start of the first cycle, the first fluid is caused to flow from the first-fluid inlet to the first opening, and during a first off-period defining a remainder of the first cycle, the first fluid is prevented from flowing from the first-fluid inlet to the first opening; and a repeating second cycle so that, during a second on-period defining a start of the second cycle, the first fluid is caused to flow from the first-fluid inlet to the second opening, and during a second off-period defining a remainder of the second cycle, the first fluid is prevented from flowing from the first-fluid inlet to the second opening;

wherein the first cycle has a first cycle period, which is a sum of the first on-period and the first off-period, and the second cycle has a second cycle period, which is a sum of the second on-period and the second off-period.

31. The method of claim 30, further comprising operating the inlet arrangement to control flow of the first fluid from the first-fluid inlet to the first opening and to the second opening.

32. The method of claim 30, further comprising causing, for a period when switching between the first mode and the second mode, operation of the inlet arrangement so that the first fluid is supplied from the first-fluid inlet to the first and second openings at the same time.

* * * * *